United States Patent [19]

Ciummo

[11] 4,317,664

[45] Mar. 2, 1982

[54] VACUUM CLEANER ATTACHMENT

[76] Inventor: Victor L. Ciummo, 503 Millers Rd., Des Plaines, Ill. 60016

[21] Appl. No.: 189,718

[22] Filed: Sep. 22, 1980

[51] Int. Cl.[3] ..... B01D 45/00

[52] U.S. Cl. ..... 55/434; 15/377; 15/350; 15/351

[58] Field of Search ..... 55/357, 434, 374, 471–473, 55/444–446; 15/350, 351, 377, 327 B, 422; 181/264, 268, 270

[56] References Cited

U.S. PATENT DOCUMENTS

| | | | |
|---|---|---|---|
| 954,164 | 4/1910 | Broekema | 15/350 |
| 1,360,517 | 11/1920 | Fuller | 181/264 |
| 1,631,391 | 6/1927 | Williams | 181/281 |
| 3,015,122 | 1/1962 | Cook | 15/327 B |
| 3,199,273 | 8/1965 | Kudsi | 55/446 |
| 3,289,399 | 12/1966 | Princiotta | 55/445 |
| 3,298,458 | 1/1967 | Deremer | 181/227 |
| 3,530,649 | 9/1970 | Porsch et al. | 181/269 |
| 4,149,611 | 4/1979 | Taguchi | 181/269 |

*Primary Examiner*—Bernard Nozick

*Attorney, Agent, or Firm*—Leo J. Aubel; Robert E. Wagner

[57] ABSTRACT

A filter assembly for a vacuum cleaner hose includes a tubular member having opposite open ends and a filter plate between said ends. In one version, the assembly is telescoped into the vacuum cleaner hose and has a reduced opening at one end with the filter plate having a solid central core that is larger than the reduced opening and passages surrounding the central core. In a second version, an enlarged intermediate portion has tubes extending therefrom that respectively telescope over and into adjacent conduit sections of the vacuum cleaner hose and the filter plate is located in the enlarged portion.

1 Claim, 6 Drawing Figures

VACUUM CLEANER ATTACHMENT

DESCRIPTION

1. Technical Field

The present invention relates generally to vacuum cleaner attachments and, more specifically, to a filtering device for removing solid objects from a vacuum cleaner hose.

2. Background of the Prior Art

The conventional vacuum cleaning system normally includes a tank which houses a motor and a collector bag with the motor producing a suction to draw dust and other materials from the carpet into the bag. The system has a section of flexible hose which has a rigid conduit at the outer end thereof that telescopingly receives a riser pipe leading from the nozzle assembly which is moved across the carpet to draw dust and other matter into the tank.

One of the most common problems with the conventional vacuum cleaner is the fact that many times larger materials, such as needles, bobby pins, hair pins, pins, coins and other similar articles are picked up by the nozzle assembly which may become trapped in the flexible hose to obstruct the passageway. In other instances, the larger solid particles will tend to become lodged somewhere between the nozzle assembly and the tank. For example, when needles or pins are picked up by the nozzle assembly, these needles and pins may become lodged in the flexible hose section of the carpet cleaner and subsequently collect other particles to produce an obstruction in the flexible hose section.

Numerous proposals have been suggested for preventing particles of the type discussed above from entering the flexible hose section. For example, U.S. Pat. No. 954,164 discloses an attachment for a pneumatic carpet cleaning system which will collect any large articles in a compartment where they can be removed prior to entry into the flexible hose section of the system. While such proposal has been in existance for a number of years, such a system has apparently never been commercially accepted in the industry. It is believed that the primary reason is the fact that the arrangement disclosed in this patent is complicated in nature and requires numerous parts which result in an increased cost to the purchaser.

SUMMARY OF THE INVENTION

According to the present invention, an extremely simplified filter system has been designed for use in any conventional vacuum cleaner to prevent solid elongated objects from passing through the flexible hose and into the collector bag. More specifically, the present invention contemplates a simple attachment which may be inserted between two rigid conduit sections such as the rigid conduit section on the free end of the flexible hose and the conduit section leading from the nozzle assembly which will prevent elongated solid articles from being passed into the flexible hose section of the carpet cleaner.

The attachment comprises a generally tubular member that has openings at opposite ends with a filter plate intermediate the openings. The filter plate has a solid central core and circumferentially spaced notches or recesses surrounding the central core while the central core has a peripheral dimension which is larger than at least one of the openings at opposite ends to produce sinuous flow paths between the openings.

In one embodiment of the invention, the tubular member has a peripheral diameter which is slightly smaller than the inside diameter of one of the rigid conduit sections and has an inwardly directed flange at one end which defines a reduced opening while the opposite end is outwardly flared to be slightly larger than the inside diameter of the rigid conduit section. The filter plate is located intermediate opposite ends of the tubular member and has a solid central core which is larger than the reduced opening with elongated passages surrounding the central core to produce non-axial flow passages through the tubular member. The tubular member is adapted to be inserted in the smaller diameter end of the flexible hose of the vacuum cleaner and is dimensioned so that the rigid riser pipe may be telescoped over the outside of the rigid conduit section in a conventional manner.

The non-axial flow passages will thereby prevent any elongated rigid particles such as needles or pins from passing through the filter section.

In another embodiment of the invention, the attachment consists of an elongated member which has an enlarged intermediate portion and tubular sections extending from the enlarged intermediate portion. The tubular sections are concentric and the enlarged section has axially spaced, substantially radial walls extending beyond the peripheries of the tubes with a plate interposed between the walls and being spaced from each wall. The plate has spaced openings around the outer perimeter with the openings being located radially outwardly of the peripheries of the tube to define non-axial flow passages through the attachment. In the specific embodiment illustrated, there are two similar plates (positioned in a relatively inverted position relative to each other), which plates have contiguous bodies and aligned openings produced by forming or bending perpendicularly-extended tabs from the body that engage the respective walls to hold the plates in proper spaced relation between the respective walls. The tabs provide further obstruction for larger elongated articles, such as needles, to prevent passage therethrough.

BRIEF DESCRIPTION OF SEVERAL VIEWS OF DRAWINGS

DETAILED DESCRIPTION

Figure 1:
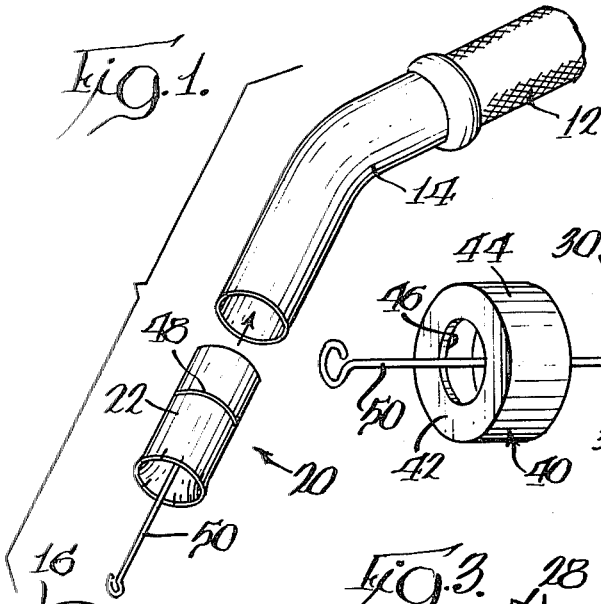
FIG. 1 is a fragmentary exploded perspective view of a hose section of a conventional vacuum cleaner having the preferred embodiment of the invention associated therewith.

While this invention is susceptible of embodiment in many different forms, there is shown in the drawing and will herein be described in detail preferred embodiments of the invention with the understanding that the present disclosure to be considered is an exemplification of the principles of the invention and is not intended to limit the invention to the embodiments illustrated.

FIG. 1 of the drawings discloses a portion of a conventional vacuum cleaner including a flexible hose 12 which has a rigid conduit section 14 at one end thereof with the opposite end being connected to the tank assembly of a conventional vacuum cleaner (not shown). A second rigid section or riser pipe 16 is normally telescoped over the outer free end of rigid tube 14 and leads to a nozzle assembly (not shown).

Figure 2:
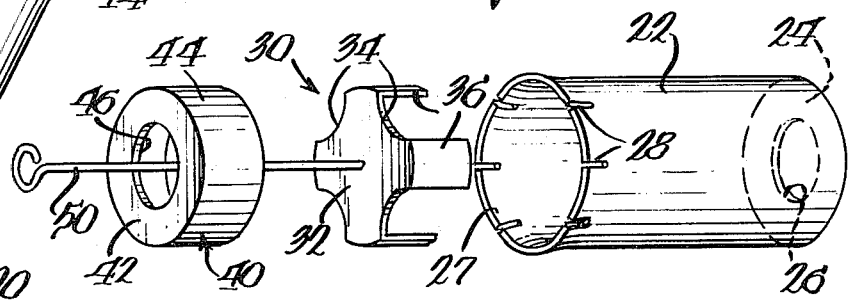
FIG. 2 is an exploded perspective view of the attachment constructed in accordance with the present invention.

According to the present invention, a filter assembly, generally designated by reference number 20, is designed to be received into the open end of rigid tube or conduit 14. The filter assembly or attachment is illustrated in more detail in the exploded view shown in FIG. 2. The filter assembly consists of a tubular member 22 which is open at both ends and has an inwardly directed flange 24 at one end. Flange 24 extends substantially perpendicular to the axis of tube 22 and defines a coaxial substantially circular opening 26 of reduced size. The opposite open end 27 of the tubular member 22 is flared outwardly slightly as indicated at 28. The outer peripheral diameter of tubular member 22 is slightly smaller than the inside diameter of conduit 14 while the flared portion is slightly larger in diameter.

The filter assembly also includes a filter plate, generally designated by reference numeral 30, which is located intermediate openings 26 and 27. Plate 30 has a substantially circular central core 32 which is preferably larger in peripheral dimension than the circular opening 26 and has circumferentially spaced notches or passages 34 around the periphery thereof. In the illustrated embodiment, four such passages are disclosed and are equally spaced around the perimeter of central core 32.

Figure 3:
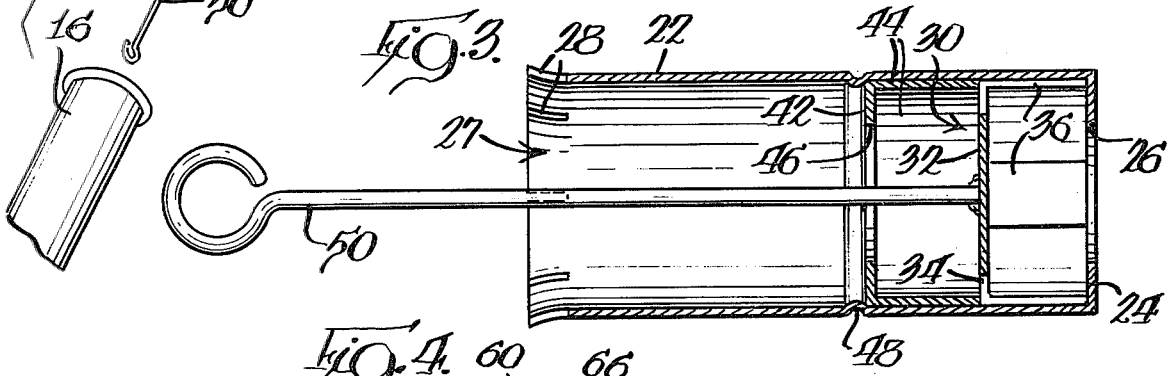
FIG. 3 is a cross-sectional view of the attachment in its assembled condition.

A filter plate 30 also has a plurality of legs or tabs 36 extending from the periphery thereof towards the inwardly directed flange 24. As shown in FIG. 3, the free ends of the legs engage the inner surface of flange 24 to accurately position the plate 20 a predetermined distance from the opening 26. This predetermined distance is preferably less than half the diameter of tubular member 22, for a purpose that will be described later.

If desired, a second spacer plate assembly 40 may be located between filter plate 30 and open end 27. This further plate 40 is preferably of cup shaped configuration and includes a plate 42 that extends diametrically across the tubular member 22 at a location spaced from the plate by a dimension that is equal to the spacing between filter plate core 32 and opening 26. The flat circular plate has a peripheral perpendicularly directed flange 44 which engages the periphery of plates 32 to define such predetermined spacing. The plate 42 also has a reduced opening 46 which is substantially equal in diameter to opening 26.

In the preferred form of the invention, the filter assembly 20 also has a handle 50 welded to plate 30 preferably centrally thereof. Handle 50 extends along the axis of tubular member 22 through opening 27 so that the handle can easily be grasped to remove the filter assembly, as will be described later.

In assembling the filter assembly 20, the filter plate 30 is first positioned or telescoped into the tubular member so that the free end of legs 36 engage flange 24. The second plate 40 is then telescoped over the handle portion 50 so that the flange 44 engages the adjacent surface of the filter plate 30. The two plates can then be permanently secured in the position illustrated in FIG. 3 merely by deforming the tubular body inwardly to produce an inwardly directed rib 48 that engages the adjacent surface of the second plate 40.

It will be appreciated from the above description that the assembled filter assembly 20 can easily be inserted into the smaller rigid tubular section 14 by grasping the handle 50 and telescoping the unit into the open end of tube 14. The outwardly flared portion 28 will prevent the tubular member from moving beyond the free edge of tube 14 because the flared end portion 28 is of a slightly larger diameter than the inside diameter of tube 14. Once installed in the tubular member 14, the riser pipe 16 can then be telescoped over the outer perimeter of tubular member 14 in the conventional manner and the filter assembly 20 will be held in position. In such position, the filter assembly 20 produces non-axial flow passages between openings 26 and 27 so that thin materials such as needles, bobby pins and hair pins cannot pass through the filter assembly. Of course, the filter assembly can be periodically removed and any materials collected therein can be removed and discarded.

It will be appreciated that the assembly can be made from either a metal or plastic material and, if desired, the second plate 40 can be eliminated since the filter plate 30 will provide non-axial flow passages for any air passing through the filter. If desired, the legs of the filter plate 30 could also be eliminated and the filter plate 30 could be held in position by deforming the body of the tubular member 22 along opposite sides of the plate to hold the plate in a fixed position with respect to opening 26. It will also be appreciated that it is not necessary that the deformation 48 extend substantially the entire circumference of tubular member 22 and this could be in the form of one or more spaced reduced indentations that would be sufficient to hold the filter plate in a fixed position. Alternatively, the filter plate could be welded if a metal tubular member is used.

Figure 4:
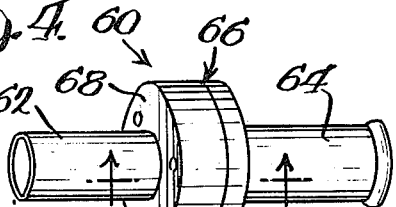
FIG. 4 is a perspective view of a slightly modified form of the invention.

A slightly modified form of the invention is illustrated in FIG. 4 and is generally designated by reference numeral 60. The filter assembly 60 includes first and second tubular member 62 and 64 with tubular members 62 being of a slightly reducing taper towards the free end thereof so that it can be received into the larger diameter opening on the free end of rigid tube 16. The second tubular member 64 is of slightly larger diameter to be telescoped over the free end of rigid tube 14.

Figure 5:
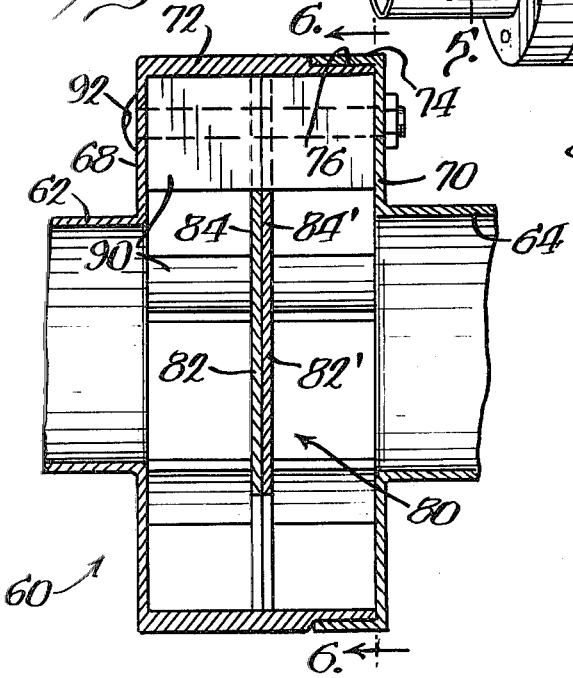
FIG. 5 is a fragmentary sectional view as viewed along line 5—5 of FIG. 4; and, FIG. 6 is a cross-sectional view as viewed along line 6—6 of FIG. 5.

The filter assembly 60 includes an enlarged intermediate portion 66 which is preferably in the form of a circular member that is defined by two substantially radially extending walls 68 and 70 that extend substantially perpendicular to the axes of the respective tubes 62 and 64. The outer peripheries of the respective radially extending walls 68 and 70 have axial extending flanges or rims 72 and 74 extending towards each other. As illustrated in FIG. 5, the one flange 72 has a recessed portion 76 at the outer end thereof and the flange 74 is adapted to be telescoped into the recessed portion.

A filter plate unit 80 is interposed between walls 68 and 70 and preferably extends parallel thereto, as more clearly shown in FIG. 5.

In the illustrated embodiment, filter plate unit 80 consists of first and second plates 82 and 82′ of similar construction. Each of plates 82 and 82′ has a central core 84 and 84′, respectively, which has a peripheral dimension that is larger than the diameter of either tube 62 or 64. Each of plates 82 and 82′ has circumferentially-spaced openings generally labeled as 88 (see FIG. 6) which are produced by deforming tabs generally labeled as 90 from the respective main body and positioning the tabs such that they extend substantially perpendicularly to the central core portions 84 and 84'. The tabs 90 of the respective plates 82 and 82' extend away from each other and the free ends of the tabs respectively engage the inner surfaces of walls 68 and 70 to position the central cores 84 and 84' substantially equal distances from the respective walls 68 and 70.

Figure 6:
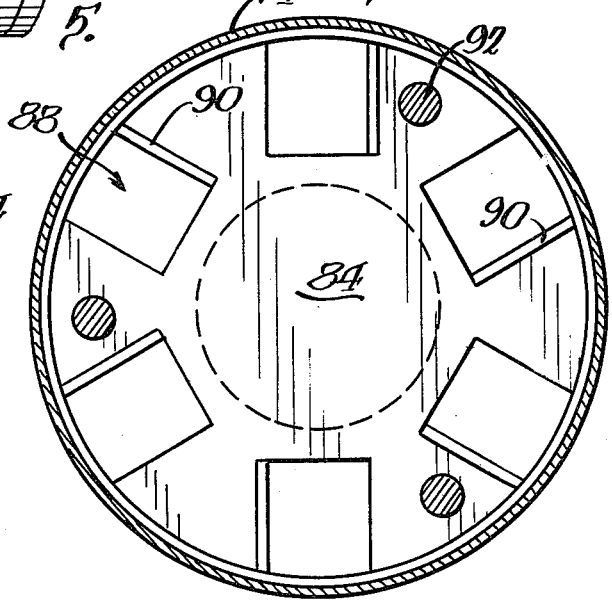

In assembly of the modified form of the invention illustrated in FIGS. 4, 5 and 6, the filter plate unit 80 is first positioned into either of the openings defined by flanges 72 or 74 and the two flanges are then telescoped to the position illustrated in FIG. 5. The two sections defining the filter assembly can then be releasably retained by utilizing screws 92 extending between walls 68 and 70. In the assembled condition, the reduced openings 88 around the perimeter of filter plate unit 80 define sinuous or non-axial flow passages through the filter assembly so that any objects, such as needles, pins, etc. are trapped within the filter assembly. The tabs also assist in providing a further obstruction and could be positioned in a non-perpendicular position with respect to the central core to provide further obstructions for a large elongated object.

Again, numerous modifications come to mind without departing from the spirit of the invention. For example, the overlapping flanges 72 and 74 could be threaded so that the screws 92 could be eliminated. Alternatively, if the unit were made from a molded plastic material, a snap fit could be utilized as the connection between the two sections. If desired, a single molded plate 82 could be used and alternate tabs 90 could be molded to extend in opposite directions.

As can be appreciated from the above description, the present invention provides an extremely simplified filter assembly for a conventional vacuum cleaner. The assembly is such that it can easily be installed and removed and does not detract from the overall functioning and appearance of the conventional vacuum cleaner. The unit is designed such that it can be quickly removed, cleaned and reinstalled without any major disassembly or special tools.

I claim:

1. A vacuum cleaner attachment comprising an elongated tubular member including an enlarged cylindrical intermediate portion, tube sections extending from said enlarged intermediate portion, said tube sections being concentric, said enlarged portion having axially spaced walls, said walls extending substantially normally to the axis of said enlarged portion and said walls extending beyond the interior peripheries of said tube sections, plate means interposed between the walls and being spaced from each wall, said plate means having spaced openings around its outer perimeter, with the openings being located radially outwardly of the peripheries of the tube sections to define non-axial flow passages through said attachment, tabs extending from said plate means in opposite directions, the free ends of said tabs respectively engaging the walls adjacent thereto to hold the plate means between said walls, and said tabs and said non-axial flow passages providing obstructions for elongated and relatively large articles to prevent passage thereof through said attachment.

* * * * *